US007461434B2

(12) United States Patent
Ackerman

(10) Patent No.: US 7,461,434 B2
(45) Date of Patent: Dec. 9, 2008

(54) SLIDER FOR CLOSURE ASSEMBLY

(75) Inventor: Bryan L. Ackerman, Freeland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 308 days.

(21) Appl. No.: 11/440,534

(22) Filed: May 25, 2006

(65) Prior Publication Data

US 2006/0265843 A1 Nov. 30, 2006

Related U.S. Application Data

(60) Provisional application No. 60/684,937, filed on May 26, 2005, provisional application No. 60/684,941, filed on May 26, 2005.

(51) Int. Cl.
*A44B 19/26* (2006.01)
*B65D 33/16* (2006.01)

(52) U.S. Cl. ..... 24/30.5 R; 24/399; 24/427; 24/585.12

(58) Field of Classification Search ..... 24/415, 24/426, 427, 428, 30.5 R, 30.5, 400, 399, 24/402, 585.1, 585.12; 383/64
See application file for complete search history.

(56) References Cited

U.S. PATENT DOCUMENTS

| | | | |
|---|---|---|---|
| 1,666,110 | A | 4/1928 | Statham |
| 2,867,877 | A | 1/1959 | Staller et al. |
| 2,875,491 | A | 3/1959 | Morin |
| 2,929,123 | A | 3/1960 | Schneideman |
| 3,074,137 | A | 1/1963 | Hawley |
| 3,103,049 | A | 9/1963 | Hawley |
| 3,115,689 | A | 12/1963 | Jacobs |
| 3,122,807 | A | 3/1964 | Ausnit |
| 3,173,184 | A | 3/1965 | Ausnit |
| 3,220,076 | A | 11/1965 | Ausnit et al. |
| 3,324,520 | A | 6/1967 | Ausnit |
| 3,426,396 | A | 2/1969 | Laguerre |
| 3,660,875 | A | 5/1972 | Gutman |
| 3,713,923 | A | 1/1973 | LaGuerre |
| 3,806,998 | A | 4/1974 | LaGuerre |
| 3,959,856 | A | 6/1976 | Ausnit |
| 4,513,484 | A | 4/1985 | Iblings |
| 4,541,117 | A | 9/1985 | Ashbeck |
| 4,922,586 | A | 5/1990 | Robson |
| 4,944,072 | A | 7/1990 | Robson |
| 5,007,142 | A | 4/1991 | Herrington |
| 5,007,143 | A | 4/1991 | Herrington |

(Continued)

FOREIGN PATENT DOCUMENTS

| | | |
|---|---|---|
| EP | 0 051 010 | 5/1982 |

(Continued)

*Primary Examiner*—Robert J Sandy

(57) ABSTRACT

A slider for use with an elongate closure mechanism includes a retention member protruding into a medial space between an upper pair of opposing interlocking members and a lower pair of opposing interlocking members. The retention members define a gap through which the upper pair of opposing interlocking members cannot pass, and that allows the slider to be slidably shifted along the length of the closure mechanism, thereby maintaining the slider operatively disposed thereon. The retention members may have the form of one or more protrusions disposed on an interior surface of a channel sidewall spaced between a top end of the channel sidewall and a bottom end of the channel sidewall.

17 Claims, 3 Drawing Sheets

U.S. PATENT DOCUMENTS 5,010,627 A 4/1991 Herrington et al.
5,020,194 A 6/1991 Herrington et al.
5,063,644 A 11/1991 Herrington et al.
5,067,208 A 11/1991 Herrington, Jr. et al.
5,070,583 A 12/1991 Herrington
5,283,932 A 2/1994 Richardson et al.
5,301,394 A 4/1994 Richardson et al.
5,442,837 A 8/1995 Morgan
5,442,838 A 8/1995 Richardson et al.
5,448,808 A 9/1995 Gross
5,664,299 A 9/1997 Porchia et al.
5,809,621 A 9/1998 McCree et al.
5,867,875 A 2/1999 Beck et al.
5,871,281 A 2/1999 Stolmeier et al.
5,896,627 A 4/1999 Cappel et al.
5,947,603 A 9/1999 Tilman
5,953,796 A 9/1999 McMahon et al.
5,956,815 A 9/1999 O'Connor et al.
5,983,466 A 11/1999 Petkovsek
6,014,795 A 1/2000 McMahon et al.
6,036,364 A 3/2000 Heuvel
6,047,450 A 4/2000 Machacek et al.
6,088,887 A 7/2000 Bois
6,112,374 A 9/2000 Van Erden
6,220,754 B1 4/2001 Stiglic et al.
6,257,763 B1 7/2001 Stolmeier et al.
6,290,391 B1 9/2001 Buchman
6,293,701 B1 9/2001 Tomic
6,305,844 B1 10/2001 Bois
6,361,209 B1 3/2002 LaRue et al.
6,439,771 B1 8/2002 Herrington, Jr.
6,477,821 B1 11/2002 Bois
6,481,890 B1 11/2002 VandenHeuvel
6,490,769 B2 12/2002 Siegel
6,595,689 B1 7/2003 Borchardt et al.
6,609,353 B1 8/2003 McMahon et al.
6,609,827 B2 8/2003 Bois et al.
6,611,996 B2 9/2003 Blythe et al.
6,632,021 B2 10/2003 Bois et al.
6,666,580 B2 12/2003 Bois
6,698,926 B2 3/2004 Buchman
6,733,178 B2 5/2004 Bois
6,739,755 B2 5/2004 Schreiter
6,755,569 B2 6/2004 Bois
6,761,481 B1 7/2004 Bois
6,789,947 B1 9/2004 Kasai
6,817,763 B2 11/2004 Tomic
6,854,887 B2 2/2005 Anderson
6,874,205 B1 4/2005 Savicki
6,880,972 B2 4/2005 Plourde
6,883,210 B1 4/2005 Savicki
6,896,409 B2 5/2005 Plourde et al.
6,902,321 B2 6/2005 Bois
6,915,546 B2 7/2005 Kasai
6,951,421 B2 10/2005 Crunkleton et al.
6,962,440 B2 11/2005 Fenzl et al.
6,996,879 B1 2/2006 Savicki
7,017,241 B2 3/2006 Bentsen
7,036,987 B2 5/2006 Crunkleton et al.
2002/0034342 A1 3/2002 Bois
2002/0034344 A1 3/2002 Bois
2003/0202718 A1 10/2003 Tomic
2003/0217444 A1 11/2003 Blythe et al.
2004/0045138 A1 3/2004 Kasai
2004/0161167 A1 8/2004 Ausnit et al.
2004/0161173 A1 8/2004 Linton et al.
2005/0008267 A1 1/2005 Linton et al.
2005/0084183 A1 4/2005 Ausnit
2006/0029300 A1* 2/2006 Yoder ..... 383/64

FOREIGN PATENT DOCUMENTS

EP 0 479 661 4/1992
EP 0 941 937 9/1999
FR 2 636 923 3/1990
JP 06-077518 11/1994
JP 08-214920 8/1996
JP 2000-023716 1/2000
JP 2000-152810 6/2000
JP 2004-161305 6/2004
WO WO 91/13759 9/1991
WO WO 92/17084 10/1992
WO WO 92/17086 10/1992
WO WO 92/19450 11/1992
WO WO 92/20252 11/1992

* cited by examiner

SLIDER FOR CLOSURE ASSEMBLY

CROSS REFERENCE TO RELATED APPLICATIONS

This application claims the benefit of U.S. Provisional Patent Application Ser. Nos. 60/684,937 and 60/684,941, each filed May 26, 2005, and hereby incorporated by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to a closure assembly, and more particularly a closure assembly including an elongate closure mechanism and a slider operationally disposed thereon, such as might be used on a pouch.

2. Description of the Background of the Invention

A pouch that has a pair of opposing pouch walls that define an opening into an interior space may be useful for storing almost any item. However, when storing liquid contents, one challenge is to minimize or eliminate leaks when the opening is closed. A pouch with a resealable closure mechanism along the opening may be particularly useful for storing liquid contents due to the ability to reseal the closure mechanism. Some such closure mechanisms have upper and lower pairs of opposing interlocking profiles to provide two seals along the opening. In addition, a slider is often used on resealable elongate closure mechanisms as a convenient device for sealing and unsealing the interlocking profiles. One challenge for many such slider closure mechanisms is slidably retaining the slider on the interlocking profiles without ripping or snagging the pouch walls and thereby causing leaks. Another challenge is to minimize or eliminate leaks around a separating member in the slider when the slider is in a fully closed position.

In one closure assembly, a rail extends along an exterior side of each of the interlocking profiles. Two opposing inwardly turned flanges along opposite bottom edges of a slider slidably abut the undersides of the rails to operatively retain the slider on the closure mechanism.

In another closure assembly, a slider is operatively disposed on an elongate closure mechanism having upper and lower pairs of opposing interlocking profiles. A separator finger depending from a top wall of the slider is disposed between the upper and lower pairs of opposing interlocking profiles. A lateral flange at a lower end of the separator finger slidably engages an underside of a rail disposed below the lower opposing interlocking profiles to operatively retain the slider on the closure mechanism.

In yet another closure assembly, a slider for a closure mechanism having upper and lower pairs of opposing interlocking profiles has an opening plow that separates the upper and lower pairs of interlocking profiles when slid in an opening direction along the closure mechanism. The plow is a vertical member depending from a top wall of the slider and a horizontal member extending laterally from a lower end of the vertical member outwardly toward left and right sidewalls of the slider between the upper and lower interlocking profiles. The horizontal member presses against a backing member extending between the upper and lower interlocking profiles to separate the interlocking profiles without having the vertical member. The horizontal member also slidably abuts an underside of the upper interlocking profiles to operatively retain the slider on the closure mechanism.

SUMMARY OF THE INVENTION

According to one aspect of the invention, a closure assembly includes an elongate closure mechanism and a slider. The closure mechanism includes upper complementary opposing interlocking members spaced from lower complementary opposing interlocking members. The slider includes a first channel sidewall and a second channel sidewall spaced opposite the first channel sidewall and a retention member protruding from the first channel sidewall toward the second channel sidewall. The elongate closure mechanism is operatively disposed between the first channel sidewall and the second channel sidewall, and the retention member protrudes between the upper complementary opposing interlocking members and the lower complementary opposing interlocking members.

According to another aspect of the invention, a slider for operatively engaging an elongate closure mechanism having upper complementary opposing interlocking members spaced from lower complementary opposing interlocking members includes a first channel sidewall and a second channel sidewall spaced opposite the first channel sidewall. The first channel sidewall and the second channel sidewall are connected at a top end of the slider and define an open bottom end of the slider opposite the top end. A retention member protrudes from the first channel sidewall toward the second channel sidewall. The retention member is spaced between the top end and the open bottom end.

Other aspects of the present invention will become apparent upon consideration of the following detailed description.

DETAILED DESCRIPTION

Figure 1:
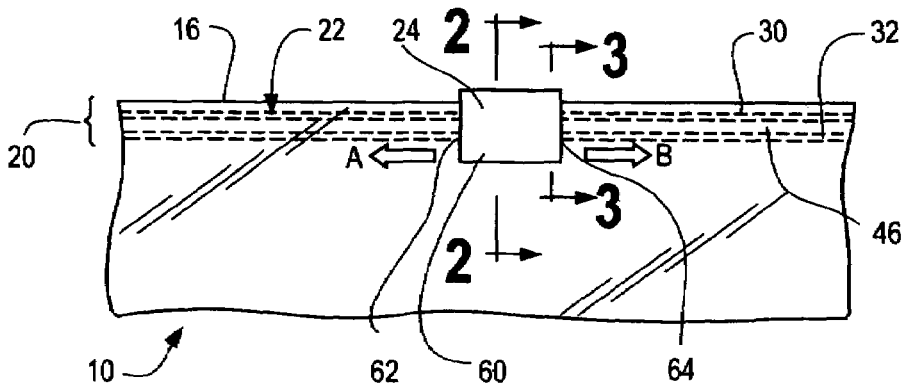
FIG. 1 is a partial side elevational view of a pouch having a closure assembly including a slider operatively disposed on an elongate closure mechanism.
Figure 2:
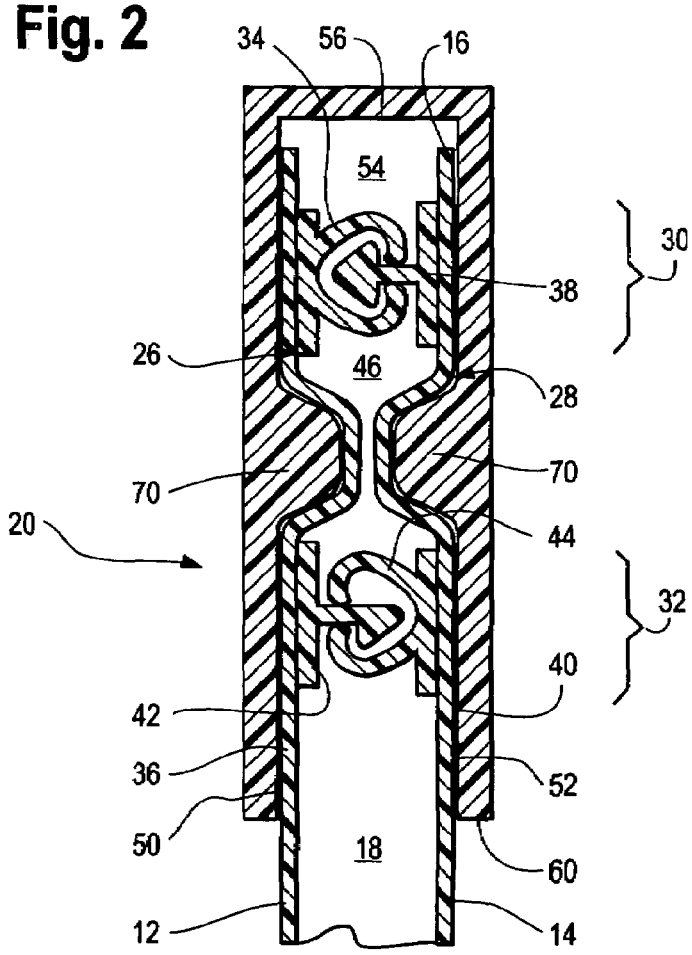
FIG. 2 is a partial cross-sectional view along the lines 2-2 of FIG. 1 with portions outside the plane of the cross-section omitted for clarity.

Turning now to the drawings, a pouch 10, shown in FIG. 1 according to one embodiment of the invention, has a left pouch sidewall 12 disposed opposite a right pouch sidewall 14, which define a mouth 16 into an interior space 18 between the left and right pouch sidewalls. (Global relational spatial terms, such as "left" and "right," "upper" and "lower," "lateral," etc., are used hereinafter in reference to the cross-sectional view shown in FIG. 2 for explanatory purposes only, it being understood that the global spatial relationships are different when the closure assembly is oriented differently.) A closure assembly 20 is disposed across the mouth 16 to facilitate sealing, opening, and/or re-sealing the pouch 10. The closure assembly 20 includes an elongate closure mechanism 22 extending longitudinally along the mouth 16 and a slider 24 operatively disposed to engage and/or disengage the elongate closure mechanism.

The closure mechanism 22 includes a left closure member 26 engagingly opposing a right closure member 28, the left and right closure members having opposing upper interlocking members 30 spaced from opposing lower interlocking members 32, as shown in dashed lines in FIG. 1. In one embodiment, the upper interlocking members 30 include an elongate female upper interlocking profile 34 disposed on a backing member 36 and an elongate male upper interlocking profile 38 disposed on a backing member 40. The lower interlocking members 32 of the same embodiment include an elongate asymmetrical male lower interlocking profile 42 disposed on the backing member 36 and an elongate female lower interlocking profile 44 disposed on the backing member 40. The upper interlocking members 30 are spaced between the mouth 16 and the lower interlocking members 32, defining a medial space 46 therebetween. The backing members 36, 40 in one embodiment are upper portions of the left and right pouch sidewalls 12, 14, and in another embodiment are discrete strips of material distinct from the left and right pouch sidewalls. In another embodiment, the upper interlocking members 30 and/or the lower interlocking members 32 may have, for example, different elongate interlocking profiles and/or may include an elongate array of discrete opposing interlocking members, such as, for example, hook and loop strips, hook arrays, and/or inter-fitting protrusions and recesses.

The slider 24 includes a left channel sidewall 50 laterally spaced from a right channel sidewall 52, which define a channel 54 extending longitudinally therebetween sized to receive the closure mechanism 22 therein. The left channel sidewall 50 is connected to the right channel sidewall 52 at an upper end thereof, such as, for example, by a top channel wall 56 extending laterally across the channel 54. The left and right closure members 26, 28 are received within the channel 54 through an open bottom end 60, an open front end 62, and an open rear end 64 such that the slider 24 may be slid along the closure mechanism 22 in a first direction and a second direction opposite the first direction when operatively disposed thereon, as shown by arrows A and B in FIG. 1.

Figure 4A:
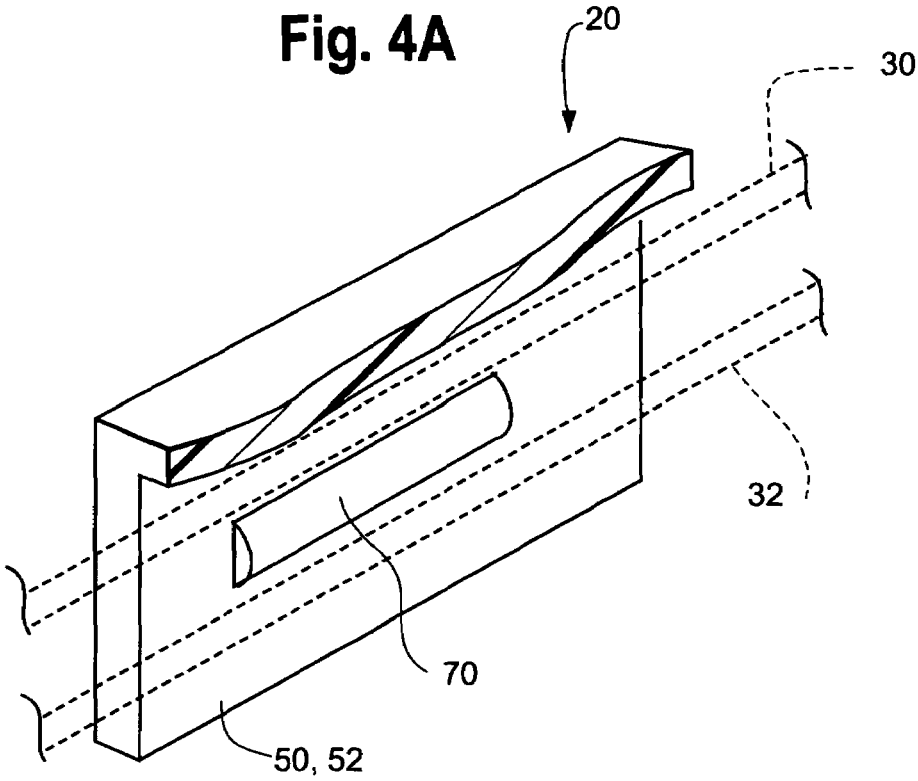
FIGS. 4A and 4B are isometric partial cutaway views of sliders according to further embodiments of the invention.
Figure 4B:
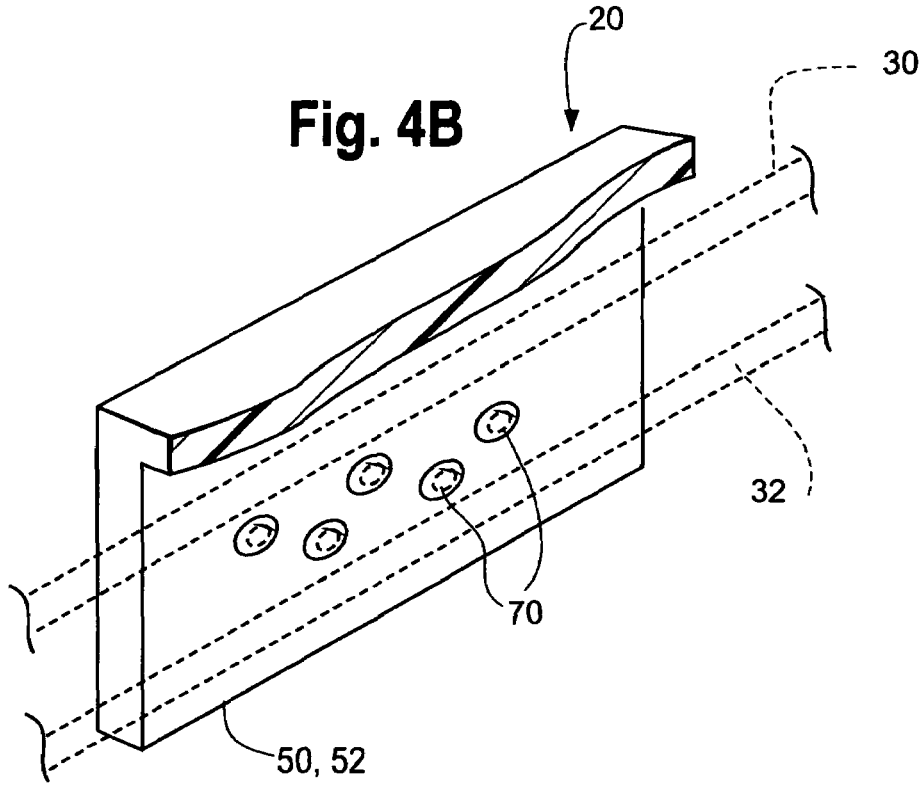

One or more retention members 70 protrude into the channel 54 on an interior side of one or more of the upper and lower interlocking members 30, 32 in order to retain the slider 24 in an operative position on the closure mechanism 22 by preventing an occluded pair of opposing interlocking members, such as 30 or 32, from passing therebetween. The retention member 70 may take any suitable form to prevent the slider 24 from falling off of the elongate closure mechanism 22 by protruding inwardly into the channel 54 from a side thereof. In the embodiment shown in FIG. 2, each retention member 70 is in the form of a protrusion disposed on an inner surface of each of the left channel sidewall 50 and the right channel sidewall 52. Each retention member 70 is spaced between the top channel wall 56 and the open bottom end 60 such that each retention member extends inwardly into the medial space 46 between the upper interlocking members 30 and the lower interlocking members 32 when the slider is operatively disposed on the closure mechanism 22, thereby also pushing the backing members 36, 40 inwardly therebetween. The retention members 70 are disposed opposite each other spaced apart a distance sufficient to allow the backing members 36, 40 to pass therebetween and not allow the occluded upper interlocking members 30 to pass therebetween, thereby slidably retaining the upper interlocking members between the retention members and the top channel wall 56. The retention members 70 also are spaced apart a distance that does not allow the occluded lower interlocking members 32 to pass therebetween, thereby effectively retaining the slider 24 in a preselected operative position on the closure mechanism 22 without requiring the aid of the top channel wall 56. In another embodiment shown in FIG. 4A, the retention members 70 include one or more elongate ridges extended longitudinally between the upper interlocking members 30 and the lower interlocking members 32. In yet another embodiment shown in FIG. 4B, the retention members 70 include a plurality of longitudinally spaced protrusions 70 on each channel sidewall 50, 52. Each of the retention members 70 may be opposing or offset from a corresponding retention member across the channel or may not have a corresponding retention member across the channel. In a further embodiment (not shown), the retention member 70 includes only a single protrusion extending from one channel sidewall 50 or 52 toward the opposite channel sidewall a distance sufficient to allow the backing members 36, 40 to pass therebetween without allowing an occluded pair of interlocking members, such as upper interlocking profiles 34 and 38, to pass therebetween. In yet another embodiment, the slider 24 is operatively disposed on an elongate closure mechanism (not shown) having only one pair of opposing interlocking members, which are retained between the top channel wall 56 and the retention members 70.

Figure 3:
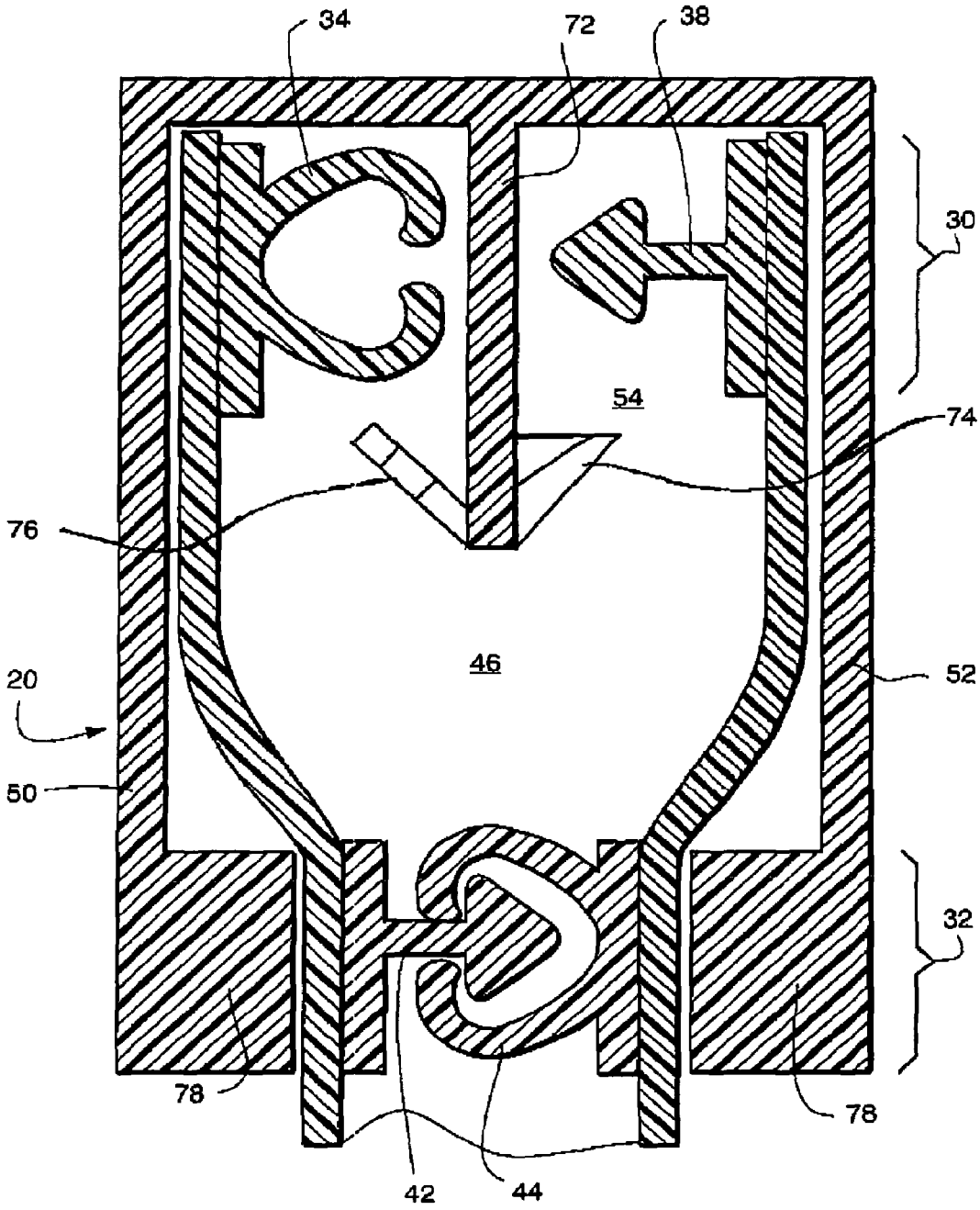
FIG. 3 is a partial cross-sectional view along the lines 3-3 of FIG. 1 with portions outside the plane of the cross-section omitted for clarity.

The slider 20 may also include other structures, such as for opening and closing the elongate closure mechanism 22. For example, in the embodiment shown in FIG. 3, the slider 24 further includes a separator member 72 disposed in the channel 54 spaced between the left channel sidewall 50 and the right channel sidewall 52 to de-occlude one or both of the opposing upper and lower interlocking members 30, 32. The separator member 72 is longitudinally displaced from the retention members 70. In another embodiment, the separator member 72 may be longitudinally aligned with the retention members 70. The separator member 72 in another embodiment may include, for example, a lateral shoulder 74, or a hook or flange 76, disposed in the medial space 46, which abuttingly engages an underside of one or both of the upper interlocking members 30, such as the interlocking profiles 34, 38, to provide an additional mechanism for retaining the slider 24 operatively disposed on the elongate closure mechanism 22. In another embodiment, the slider 24 may include closure protrusions, such as, for example, opposing pairs of closure bars 78, extending into the channel 54 from the left and/or right channel sidewalls 50, 52 to engage the lower interlocking profiles 42, 44 to occlude and/or reseal the same. Another set of similar closure bars may be disposed at another location to close the upper interlocking profiles 34, 38. In such an embodiment, the slider 24 may be used to at least partly open and at least partly reseal the closure mechanism 22 by urging the slider 24 in an opening direction, such as A, to open at least one of the upper and lower opposing interlocking members 30, 32 and by urging the slider in a closing direction, such as B, opposite the opening direction to occlude at least one of the upper and lower opposing interlocking profiles. The slider may include other opening and closing structures known in the art in addition or alternatively to the exemplary structures shown herein.

The closure assembly 20, including the closure mechanism 22 and the slider 24, may be made of any material suitable for providing a relatively resilient slider and a relatively flexible closure mechanism. In one embodiment, the slider 24 is molded of relatively stiff or rigid polymeric material, and the closure mechanism 22 is extruded with a more pliable polymeric resin.

INDUSTRIAL APPLICABILITY

The retention members described herein provide a simple and economical way to operatively retain a slider on an elongate closure mechanism, such as in the closure assembly described herein, which provides a convenient mechanism for sealing, opening, and/or resealing a pouch, such as, for storing products therein. Of course, the closure assembly may be used for sealing and resealing openings of almost any kind. Further, disposing the retention members into the medial space between the upper interlocking members and the lower interlocking members minimizes potential wear to the pouch side walls on the interior side of the lower interlocking members and thereby helps maintain the integrity of the pouch.

Numerous modifications to the present disclosure will be apparent to those skilled in the art in view of the foregoing description. Accordingly, this description is to be construed as illustrative only and is presented for the purpose of enabling those skilled in the art to make and use the closure assembly of the disclosure and to teach the best mode of carrying out same.

I claim:

1. A closure assembly comprising:

an elongate closure mechanism, the closure mechanism including upper complementary opposing interlocking members spaced from lower complementary opposing interlocking members; and a slider including a first channel sidewall and a second channel sidewall spaced opposite the first channel sidewall and a retention member protruding from the first channel sidewall toward the second channel sidewall;

wherein the elongate closure mechanism is operatively disposed between the first channel sidewall and the second channel sidewall, and the retention member protrudes between the upper complementary opposing interlocking members and the lower complementary opposing interlocking members, wherein the slider includes a top channel wall connecting the first channel sidewall and the second channel sidewall at the top ends thereof, and wherein the slider includes a separator member depending from the top channel wall adapted to de-occlude at least the upper complementary opposing interlocking members.

2. The closure assembly of claim 1, further comprising a second retention member protruding from the second channel sidewall toward the first channel sidewall, wherein the second retention member protrudes between the upper complementary opposing interlocking members and the lower complementary opposing interlocking members.

3. The closure assembly of claim 2, wherein the first retention member opposingly faces the second retention member.

4. The closure assembly of claim 1 , wherein the retention member includes an elongate ridge extending between the upper complementary opposing interlocking members and the lower complementary opposing interlocking members.

5. The closure assembly of claim 1, wherein at least one pair of the complementary opposing interlocking members comprises male and female elongate interlocking profiles.

6. The closure assembly of claim 1, wherein an end of the separator member opposite the top channel wall further comprises a lateral extension operatively disposed to abuttingly engage an underside of a respective one of the upper complementary opposing interlocking members.

7. The closure assembly of claim 1, wherein the separator member is longitudinally offset from the retention member, and wherein the separator member is adapted to deocclude the lower complementary opposing interlocking members.

8. The closure assembly of claim 1, wherein the slider further comprises at least one closure member operatively positioned to occlude at least one pair of the complementary opposing interlocking members.

9. The closure assembly of claim 8, wherein the closure member comprises an opposing pair of closure bars.

10. A closure assembly comprising:

an elongate closure mechanism, the closure mechanism including upper complementary opposing interlocking members spaced from lower complementary opposing interlocking members; and a slider including a first channel sidewall and a second channel sidewall spaced opposite the first channel sidewall and a retention member protruding from the first channel sidewall toward the second channel sidewall;

wherein the elongate closure mechanism is operatively disposed between the first channel sidewall and the second channel sidewall, and the retention member protrudes between the upper complementary opposing interlocking members and the lower complementary opposing interlocking members, wherein the retention member includes a plurality of protrusions aligned between the upper complementary opposing interlocking members and the lower complementary opposing interlocking members.

11. A slider for operatively engaging an elongate closure mechanism having upper opposing interlocking members spaced from lower opposing interlocking members, the slider comprising:

a first channel sidewall and a second channel sidewall spaced opposite the first channel sidewall, the first channel sidewall and the second channel sidewall connected at a top end of the slider and defining an open bottom end of the slider opposite the top end; and a retention member protruding from the first channel sidewall toward the second channel sidewall, the retention member spaced between the top end and the bottom end so as to be disposed between the upper opposing interlocking members and the lower opposing interlocking members when the slider operatively engages the elongate closure mechanism, wherein a top channel wall connects the first channel sidewall and the second channel sidewall at the top end, and a separator member depending from the top channel wall is adapted to deocclude the upper complementary opposing interlocking members.

12. The slider of claim 11, further including a second retention member protruding from the second channel sidewall toward the first channel sidewall, the second retention member spaced between the cop end and the bottom end.

13. The slider of claim 12, wherein the first retention member is opposingly spaced from the second retention member.

14. The slider of claim 11, wherein the retention member includes an elongate ridge.

15. The slider of claim 11, wherein an end of the separator member opposite the top channel wall further comprises a hook operatively disposed to abuttingly engage an underside of a respective one of the upper complementary opposing interlocking members.

16. The slider of claim 11, wherein the slider comprises at least one closure member operatively positioned to occlude at least one pair of the complementary opposing interlocking members.

17. A slider for operatively engaging an elongate closure mechanism having upper opposing interlocking members spaced from lower opposing interlocking members, the slider comprising:

a first channel sidewall and a second channel sidewall spaced opposite the first channel sidewall, the first channel sidewall and the second channel sidewall connected at atop end of the slider and defining an open bottom end of the slider opposite the top end; and a retention member protruding from the first channel sidewall toward the second channel Sidewall, the retention member spaced between the top end and the bottom end so as to be disposed between the upper opposing interlocking members and the lower opposing interlocking members when the slider operatively engages the elongate closure mechanism, wherein the retention member includes a plurality of spaced protrusions.

* * * * *

UNITED STATES PATENT AND TRADEMARK OFFICE

CERTIFICATE OF CORRECTION

PATENT NO. : 7,461,434 B2
APPLICATION NO. : 11/440534
DATED : December 9, 2008
INVENTOR(S) : Bryan L. Ackerman It is certified that error appears in the above-identified patent and that said Letters Patent is hereby corrected as shown below:

Column 6, Line 50: replace “cop” with --top--

Column 7, Line 4: replace “atop” with --a top--

Column 7, Line 7: replace “Sidewall” with --sidewall--

Signed and Sealed this

Seventeenth Day of March, 2009

JOHN DOLL
*Acting Director of the United States Patent and Trademark Office*